United States Patent [19]

Innocenti, Sr. et al.

[11] Patent Number: 4,919,358

[45] Date of Patent: Apr. 24, 1990

[54] REWIND SHELL FOR TEXTILES

[76] Inventors: Emil Innocenti, Sr., 166 Beverly Rd., Hawthorne, N.J. 07506; Philander N. Alward, 87 E. Crescent Ave., Allendale, N.J. 07401

[21] Appl. No.: 396,535

[22] Filed: Aug. 21, 1989

Related U.S. Application Data

[63] Continuation of Ser. No. 197,111, May 20, 1988, abandoned.

[51] Int. Cl.[5] ..... B65H 18/08; B65H 75/08

[52] U.S. Cl. ..... 242/68.4; 242/68.5; 242/68.6

[58] Field of Search ..... 242/118.3, 118.31, 188.32, 242/68.5, 68.6, 68, 68.4, 46.2, 46.21, 46.3, 129.51

[56] References Cited

U.S. PATENT DOCUMENTS

| | | | |
|---|---|---|---|
| 1,545,661 | 7/1925 | Johnson | 242/68.6 |
| 1,793,180 | 2/1931 | Latham | 242/68.4 |
| 1,803,180 | 4/1931 | Gargolinski | 242/68.4 |
| 3,447,674 | 6/1969 | Fraser | 242/68.5 |

*Primary Examiner*—Stanley N. Gilreath

*Attorney, Agent, or Firm*—Abelman Frayne Režac & Schwab

[57] ABSTRACT

A rewind shell having particular utility in the textile industry is comprised of radially extending webs arranged in an angularly displaced array symmetrically about a common longitudinal axis of the rewind shell, the webs each having flanges at their radially outer edges curved about a radius of the common longitudinal axis, the webs and flanges being formed integrally as a unitary metal extrusion. End caps are provided at each end of the rewind shell having support segments extending into the interior of the shell for them to dimensionally stabilize the shell.

4 Claims, 3 Drawing Sheets

REWIND SHELL FOR TEXTILES

This application is a continuation of application Ser. No. 197,111, filed May 20, 1988, now abandoned.

FIELD OF THE INVENTION

This invention relates to rolls or mandrels employed in the winding of textile fabrics, or other materials such as paper or scrim in continuous sheet form, to provide a roll of such material.

The rewind shell of the present invention finds particular application as an adjunct to wet method processes in the textile industry, such as vat dyeing, fixing, washing and the like finishing processes, in which the fabric progressively emerges from the processing station in a wet condition, and as a consequence is extremely heavy. Unless the fabric can proceed directly to a next succeeding processing station or to a tentering and drying processing station, then, it must be at least temporarily bulk stored in rolls.

Typically, a roll of such material will weigh in the order of 2,000 to 3,000 pounds.

BACKGROUND OF THE INVENTION

Traditionally rewind shells have been formed from wood. Wood, however, is prone to shrinkage if left to dry out, swelling if used in wet applications, and, is prone to warpage and sagging under loading, in which event the roll will become other than axially straight.

Further, it is necessary for the rewind shell to be provided at its ends with trunnions, whereby it can be supported in bearings of a rewind machine, and, appropriately rotated during a rewind operation by a drive provided by the rewind machine.

If a rewind operation must be halted while in progress, this can produce extremely high torsional stresses at the ends of the rewind shell, and thus produce extremely high shear stresses at the ends of the rewind shell and its interconnection with the associated trunnions. Unless extreme caution is exercised in the design of such rewind shells, and even in the event that extreme caution is exercised, the torsional forces can result in splitting of the wood rolls in the direction of the grain, thus severely impairing the structural integrity of the rewind shell and resulting in its possible disintegration and collapse under the weight of the supported textile material.

SUMMARY OF THE INVENTION

According to the present invention, the use of dimensionally unstable and structurally weak wood in a rewind shell is avoided in its entirety, the rewind shell of the present invention being formed from a material which is entirely dimensionally stable, and which is incapable of any shrinkage expansion, warpage or splitting.

According to the present invention, the rewind shelll is formed from a hydrophobic material, preferably an extrudable, light-weight metal. Aluminum or high-strength alloys of aluminum are preferred in view of their relatively light-weight, dimensional stability, and relative ease of workability by extrusion molding.

In order to further decrease the weight of the rewind shell without sacrifice of its structural strength and its ability to remain axially straight under severe lateral loading, the rewind shell is formed as a hollow cylinder having internal reinforcements extruded integrally therewith in the form of axially continuous, angularly spaced internal radial webs which are interconnected with each other internally of the rewind shell. In this manner, the rewind shell is reinforced against sagging for it to remain axially straight, and, distortion of the external cylindrical wall of the shell to an out of round condition is virtually precluded, any lateral forces being disipated in the internal arrangement of webs.

In function, the rewind shell of the present invention is comprised of a plurality of I-beams or T-beams their webs symmetrically disposed about the central longitudinal axis of the rewind shell and interconnected with each other in angularly displaced orientation, the flanges of the I-beams or T-beams being interconnected with the next adjacent end flange and curved at a radius about the central longitudinal axis for the end flanges to provide a continuous external cylindrical surface of the rewind shell. Compressive stresses exerted radially on the rewind shell are thus translated by the radially extending webs into axially directed tensional stresses at the diametrically opposite side of the roll, in the same manner as an I-beam functions in a load-bearing structure, acting to eliminate any tendency of the rewind shell to sag between its ends and acting to maintain the rewind shell in an axially straight condition.

Preferably, the rewind shell is provided during the extrusion thereof with a central hollow core of square or polygonal cross-section, and which is extruded integrally with the radially extending webs, for the entire outer cylinder, webs and the hollow core to comprise a single unitary extrusion.

The central hollow core can be employed to accomodate a support shaft of complimentary cross-section to the internal cross-section of the hollow core, or, can be employed to accomodate stub shafts of complimentary cross-section of trunnions to be provided at the respective ends of the rewind shell. In this manner, a direct rotational drive can be provided from the support shaft or the stub shafts without any need to pin the rewind shell to the associated shafts, thus eliminating any members that are subject to shear stress failure such as arise at the time the rewind shell is braked either during or at the end of a rewind operation.

DESCRIPTION OF THE DRAWINGS

The invention will not be described with reference to the accompanying drawings which illustrate preferred embodiments of the invention, and, in which.

DESCRIPTION OF THE PREFERRED EMBODIMENTS

Figure 1:
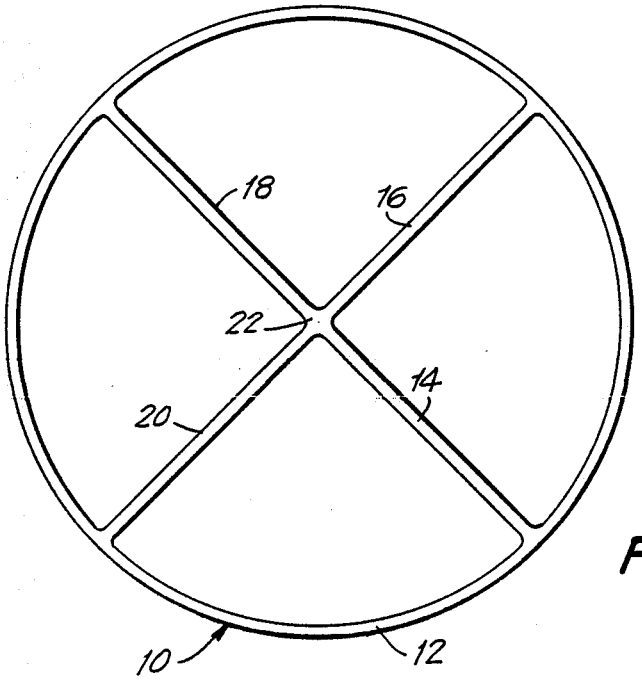
FIG. 1 is an end view of one form of rewind shell according to the present invention.
Figure 2:
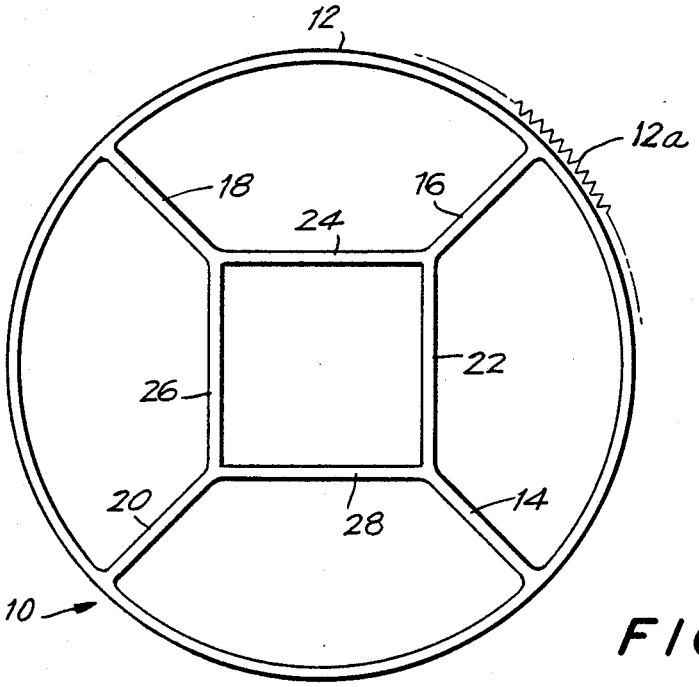
FIg. 2 is an end view of a preferred form of rewind shell according to the present invention.

Referring firstly to FIG. 1, the rewind shell is indicated generally at 10. The rewind shell is of hollow tubular formation and includes a continuous peripheral outer wall 12 and axially continuous internal reinforcements 14, 16, 18 and 20 in the form of radially extending webs. The outer wall 12 can either be smooth, as illustrated in FIG. 2 or, it can be axially striated at 12A to increase its frictional grip on material being wound onto the shell.

The hollow tubular outer wall 12 and the reinforcing webs 14–20 are each formed integrally with each other, the entire structure being formed as a single extrusion of a light-weight metal. A preferred metal employed for the extrusion is USS 6063-T6 aluminum. It will, however, be appreciated that other forms of aluminum and alloys thereof suited to an extrusion molding operation equally well could be employed.

Additionally, it will be appreciated that for large diameter rewind shells and extremely heavy duty applications more than four radial webs can be employed.

Typically, such rewind shells are required in 40, 60, 76, 90 and 120 inch lengths and more. Also, typically, such rewind shells are of four inches or more in outside diameter. Thus, as will be apparent, the contained volume of such rewind shells is very considerable, for example, a 60 inch rewind shell of 4 inches diameter would present an internal volume of approximately 754 cubic inches, and thus, if formed as a solid cylinder would be of considerable weight even if formed from a lightweight metal.

Clearly, such a weight penalty cannot be tolerated, in view of which attempts have been made to reduce the weight of such a solid rewind shell, by instead forming it as a hollow cylindrical tube.

While this resulted in the desired reduction of weight of the rewind shell, it was found that such rewind shells were unsatisfactory in performance, in that under heavy transverse loading, such tubular rewind shells literally collapsed by the distortion and collapsing inwardly of the outer cylindrical wall thereof.

For this reason, it was considered that a hollow cylindrical rewind shell was impractical, in that the wall thickness thereof would have to be made so great as to result in a rewind shell of almost the same weight as that of solid rewind shell, and also the feasibility of forming such rewind shells by extrusion molding was negated.

These problems are overcome by the present invention in an entirely satisfactory manner, and which results in a rewind shell having a weight which is only a small fraction of the weight of a solid rewind shell but which is capable of supporting loads of up to 3,000 lbs. without failure under loading, the rewind shell of the present invention accomplishing this with a wall thickness of the outer hollow cylinder of less than 1/10 of an inch. by employing the teachings of the present invention, desirable characteristics of a solid rewind shell are retained, while avoiding the major disadvantage of the weight penalty of such a solid rewind shell. In addition, the resulting rewind shell is of far greater structural strength than conventional wood rewind shells, and additionally, the known disadvantages of such wood rewind shells in terms of their lack of dimensional stability and their proclivity to sag and become other than axially straight are eliminated, as is the possibility of disintegration of the structure of the wood itself of such wood rewind shells particularly under torsional loading.

By forming the rewind shell of the present invention as a relatively thin-walled hollow cylinder, an enormous saving in the cost of materials required to form a solid metal rewind shell of corresponding dimensions is accomplished, and the major disadvantage of such a solid rewind shell in terms of its weight is reduced to an almost insignificant minimum. Further, the cost of the materials required in the formation of the rewind shell of the present invention is so low as to reduce the costs of the rewind shell including the manufacturing costs to approximately the cost of conventional wooden rewind shell.

The reasons for the extremely high structural strength of the rewind shell of the present invention reside in the radial webs contained within and extruded integrally with the relatively thin and structurally weak exterior hollow cylinder.

The effect of the radial webs closely approximates the spokes, for example, of a bicycle wheel. Any attempt by the cylinder to move to an out-of-round condition results in tensile or compressive stresses being set up in the respective webs which act to resist movement of the cylinder into an out-of-round condition. Additionally, compressive stresses exerted on the cylinder at one side of its diameter are translated through the radially extending webs into axially directed tensile stresses in the webs and the cylinder wall at the diametrically opposite side of the cylinder, such tensile stresses acting to resist sagging movement of the cylinder between its ends, such as would cause the cylinder to become other than axially straight.

The effects secured by the rewind shell of the present invention are closely similar to those arising in I-beams employed in building and other constructions, the diametrically aligned radially extending webs 14, 18 and 16, 20 comprising the web of an I-beam, and the associated portions of the outer cylindrical portion 12 constituting the flanges of the I-beam. The respective flanges of the I-beams are interconnected with each other at their longitudinal edges, and are curved on the radius of the cylinder in order to provide the external cylindrical configuration of the rewind shell.

In an I-beam, as in the rewind shell of the present invention, a compressive load acting on the flanges at one edge of the web is translated through the web into axially directed into tensile forces at the opposite edge of the web, the flanges at the said opposite edge of the web also being placed under tensile stress, this resulting in a structure of relatively minor weight as compared with its enormous load carrying capability and its dimensional stability.

Thus, the rewind shell of the present invention can be considered as a plurality of I-beams having their webs disposed angularly relative to each other in a spoke-like configuration symmetrically about a common longitudinal axis. The connection of the adjacent flanges of the respective I-beams to each other results in a structure that is considerably stronger than if the respective flanges were free of each other at their longitudinal edges, the interconnection of the respective flanges acting to disperse hoop stresses produced in the cylindrical array of flanges, and preclude flexure of the associated webs in directions transverse to their longitudinal axis, lateral flexure of the respective webs also being resisted by the other webs with which they are interconnected.

While the embodiment of FIG. 1 is operative in overcoming the majority of the deficiencies in wooden rewind shells, some means must be provided at the ends of the shell to attach the rewind shell to trunnions of the rewind machine, this requiring that axial flanges of the trunnions which encircle the free ends of the rewind shell to be pinned to the rewind shell in order to preclude relative rotation between those members. As in wooden rewind shells, any such radial pinning of the end caps of the trunnions to the rewind shell is prone to shear stress failure upon braking of a loaded rewind shell, the shear stresses arising from the very considerable rotational kinetic energy stored within the rotating material carried by the shell. Additionally, shear stresses acting an opposite rotational direction would be exerted on the pins, in the event that a partially loaded rewind shell has been stopped during a rewind operation, and the rewind operation is subsequently restarted.

In order to eliminate any such radial pinning of the axial flanges of the trunnions to the ends of the rewind shell, preferably, the rewind shell is formed as now discussed with respect to FIGS. 2, 3 and 4, or 2, 4, 5 and 6.

Figure 3:
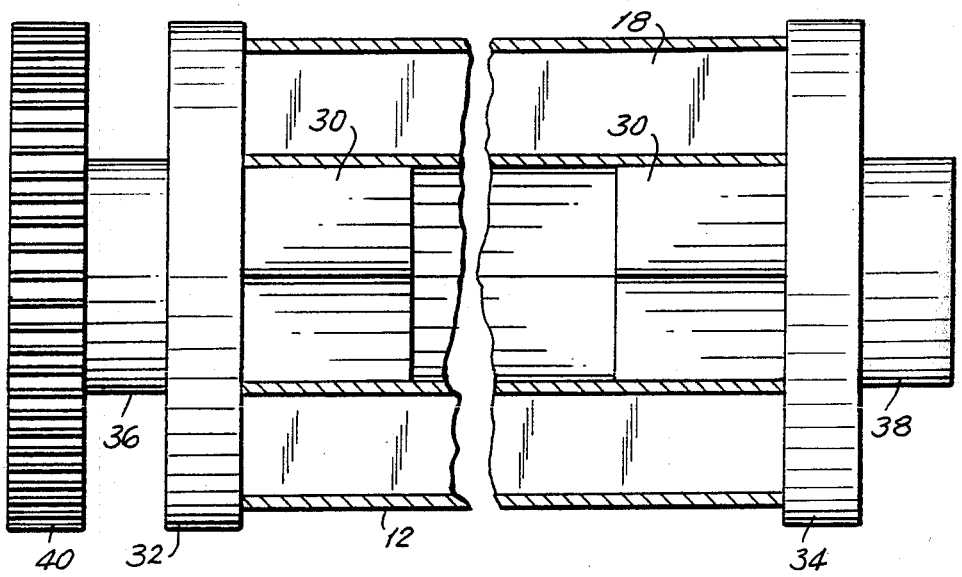
FIG. 3 is a longitudinal cross-section through the rewind shell of FIG. 2, and showing its association with end trunnions.
Figure 4:
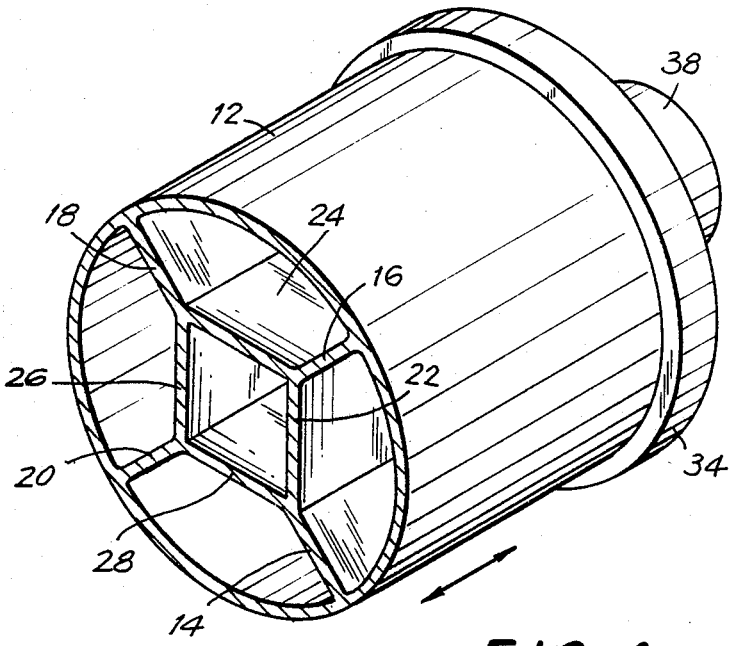
FIG. 4 is a fragmentary perspective view showing in cross section the right-hand side of the cylinder and its supporting trunnion as shown in FIG. 3.

According to the preferred embodiment of the invention, the rewind shell is additionally formed internally with a hollow cylinder of polygonal cross-section, this being shown as of square cross-section in FIGS. 2–4. As will be clearly apparent, the internal cylindrical core member could be other than square in cross-section, the square cross-section being dictated more particularly by the employment of four equally angularly spaced radial webs in the illustrated embodiment.

The central hollow cylindrical core member is comprised of axially continuous wall members 22, 24, 26 and 28, that have been extruded integrally with the cylindrical wall 12 and the radially extending webs 14–20. Thus, the cylindrical outer wall, the radially extending webs and the wall members of the central core are each formed integral with each other in an axially continuous manner.

Figure 5:
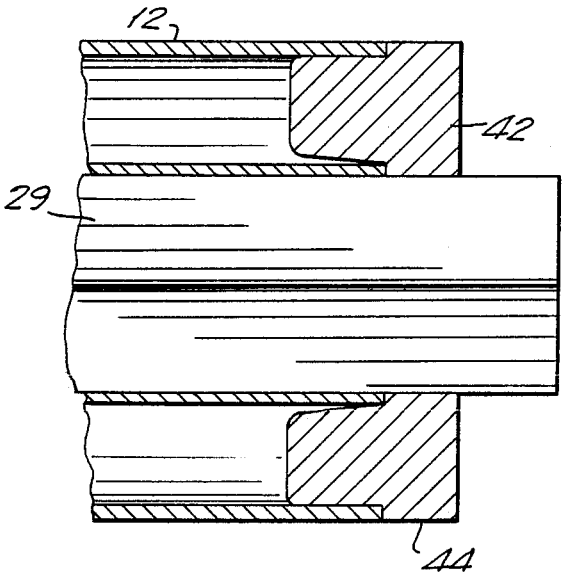
FIG. 5 is a longitudinal cross-section through an alternative mounting of the rewind shell.

As is illustrated in FIG. 3, by forming the rewind shell with a hollow central core, then, the rewind shell can be placed directly onto the driven axle of complimentary cross-section, typically a 1.25 "square steel drive bar 29 as illustrated in FIG. 5, or, as illustrated in FIG. 3, it can receive the pintles 30 of complementary square cross-section of end trunnions 32 and 34. The end trunnions 32 and 34 are provided with conventional support shafts 36 and 38, one of which is driven by a conventional spur gear 40.

Thus, according to the preferred embodiment, a direct drive is obtained between the support shaft 29 or the pintles 30 in the absence of any requirement to pin the rewind shell 12 to its support shaft or to the end trunnions. This is accomplished without in any way impairing the ability of the radial webs 14–20 to act in exactly the same manner as described above with reference to FIG. 1, and, in fact, the rewind shell is further reinforced by the presence of the internal hollow cylinder comprised by the axially continuous walls 22–28, which, by virture of their interconnection, act as an extremely strong box beam, which itself is inherently capable of resisting deformation under lateral loading in a closely similar manner to that of the I-beams discussed above, the respective axially continuous sidewalls 22–28 being capable of dissipating stresses arising in the rewind shell, and, translating those stresses to the radial extending webs at diammetrically opposite sides of the cylindrical core.

The hollow cylindrical core can be made rectangular, or, for that matter of any other polygonal form with equal ease and facility, regardless of the number of radial webs that are incorporated into the rewind shell, this being made possible in the extrusion of the composite rewind shell.

Figure 6:
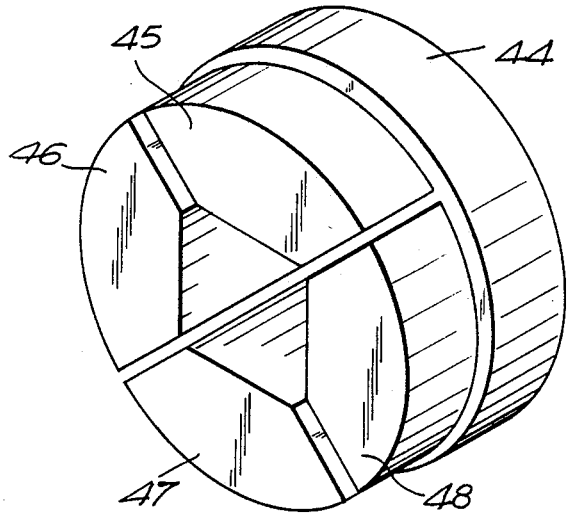
FIG. 6 is a perspective view of an end support cap employed in FIG. 5.

Referring now to FIGS. 5 and 6, driving dogs 42 are provided at the respective ends of the rewind shell, the dogs 42 conveniently being formed as castings of ductile iron, steel, or a lightweight alloy. The driving dogs are formed integrally with an annular flange 44 having a central bore of complimentary cross-section to that of the drive bar 29. Extending axially from the flange 44 are a number of driving dogs 45–48 complimentary in number and shape to the axial apertures in the rewind shell defined by the radially extending webs 14–20. The external radium of the driving dogs is identical with the inner radius of the outer wall 12 for them to provide direct support for the outer wall 12 at the ends of the shell. Optionally, the inner surfaces of the driving dogs can be slightly tapered to facilitate insertion of those members into the shell.

As will be appreciated from FIGS. 5 and 6, the annular flange 42 and the driving dogs 45–48 each are of a dimension in the direction of the longitudinal axis of the rewind shell that is considerably greater than the wall thickness of the webs 14–20 and that of the peripheral outer wall 12.

In this manner, the respective driving dogs 45–48 are operative to prevent movement of the respective webs 14–20 from their radially extending orientation in which they have been initially formed, the driving dogs also being operative to prevent movements of the peripheral outer wall 12, particularly in radially inward directions such as could result in collapsing of the rewind shell at its respective ends.

In this manner, direct support is provided for the ends of the shell precluding collapsing or distortion of the shell, while at the same time a direct drive is provided from the shaft 29 and through the driving dogs 45–48 to the webs 14–20 minimizing torsional deformation of the shell under torque loading.

Various other modifications will suggest themselves to the person skilled in the art..For example, instead of the respective flanges of the respective I-beams being formed as interconnected with each other, they could infact be axially separate from each other, thus providing continuous axially extending slits in the outer surface of the cylinder 12. Such axial slitting of the cylinder would, of course, reduce its total overall strength in that the axial slitting would eliminate the capability of the respective flanges of dissipating hoop stresses arising in the cylindrical outer periphery of the rewind shell

We claim:

1. A rewind shell assembly, of particular utility in wet processing in the textile industries, comprised of:

a unitary extrusion of an extrudable metal providing, in transverse cross-section, radially extending webs extending in angularly spaced relation radially of a central longitudinal axis of said extrusion, and each interconnected with the other at a radially inner longitudinal edge of each said web;

a laterally extending flange integral with each said web at a radially outer edge of each said web, each flange being curved about a radius of said central longitudinal axis; and, a drive member separate from said rewind shell and inserted into each axial end of said unitary extrusion, each said drive member including a radially extending flange portion, and, driving dogs formed integrally with said radially extending flange portion and respectively extending axially into said unitary extrusion, said respective driving dogs being of substantially greater axial length than the wall thickness of said respective webs and each having axially extending walls complimentary to an adjacent pair of said webs and their associated said flanges for each said driving dog to internally engage a said adjacent pair of said webs and said associated flanges in supporting and driving relationship therewith;

said driving dogs being operative to prevent movement of said webs from their radially extending orientation and being operative to prevent collapsing movement of said laterally extending flanges in directions radially inwardly of said unitary extrusion.

2. The rewind shell of claim 1, in which said laterally extending flanges are formed integrally with the next adjacent laterally extending flanges as a unitary extrusion of an extrudable metal to provide a continuous circumferential outer surface of said rewind shell.

3. The rewind shell of claim 1, further including an internal hollow cylinder formed integrally with said webs as said unitary extrusion of extrudable metal, said hollow cylinder having its longitudinal axis coincident with said common longitudinal axis of said rewind shell, and being of polyganol transverse cross-section.

4. The rewind shell of claim 3, in which said internal hollow cylinder is of square transverse cross-section.

* * * * *